United States Patent [19]

Engdahl

[11] Patent Number: 4,697,707

[45] Date of Patent: Oct. 6, 1987

[54] CONTAINER FOR FRAGILE FOOD SUBSTANCE

[76] Inventor: Bernard Engdahl, 15282 Moulins Circle, Irvine, Calif. 92714

[21] Appl. No.: 857,720

[22] Filed: Apr. 30, 1986

[51] Int. Cl.[4] ..... B65D 81/02

[52] U.S. Cl. ..... 206/585; 229/902; 229/DIG. 13; 426/106

[58] Field of Search ..... 206/485, 560, 585, 591-594; 229/15, 902, DIG. 4, DIG. 13; 426/106, 113, 119, 124, 128

[56] References Cited

U.S. PATENT DOCUMENTS

| | | | |
|---|---|---|---|
| 2,732,122 | 1/1956 | Bolding | 229/DIG. 4 |
| 2,827,219 | 3/1958 | Sparks | 206/592 |
| 3,559,866 | 2/1971 | Olson, Sr. | 206/591 |
| 3,820,708 | 6/1974 | Sieffert | 206/592 |
| 3,884,356 | 5/1975 | Lidgard | 206/591 |
| 4,018,905 | 4/1977 | Adamek et al. | 426/128 |
| 4,299,850 | 11/1981 | Wallen et al. | 426/128 |
| 4,381,837 | 5/1983 | Cortopassi | 426/128 |
| 4,579,276 | 4/1986 | Manizza | 229/15 |

*Primary Examiner*—Stephen Marcus
*Assistant Examiner*—Jimmy G. Foster
*Attorney, Agent, or Firm*—Price, Gess & Ubell

[57] ABSTRACT

An improved packaging blank for contiguously aligned taco shells is provided with at least one holding member that frictionally engages the opposing interior surfaces of one shell. The holding member has serrated edges that include contact points. Perforations are also provided in the holding member to provide a resilient character to the serrated edges. A bottom member interfaces the exterior surface of another shell to assist in maintaining the shells in a position within the blank.

6 Claims, 6 Drawing Figures

CONTAINER FOR FRAGILE FOOD SUBSTANCE

BACKGROUND OF THE INVENTION

1. Field of the Invention

The present invention relates generally to food containers and, specifically, to an improved container for packaging fragile or brittle food substances that enables a consumer to view the food in the container without having to open it.

2. Brief Description of the Prior Art

In the packaging and container field, and specifically as the field relates to food substances, artisans have continually sought solutions to the problem associated with packaging brittle or fragile food substances for human consumption. Agitation of the container and its contents during shipping and handling frequently damages the food substance to varying degrees. The degree of damage is of course dependent upon the forces applied to the container and the extent to which the container prevents the forces from acting upon the contents.

In the Mexican food industry, these problems are magnified where corn is processed into a substance having a brittle consistency and a particular configuration, such as taco shells. Conventionally processed taco shells are known to be very brittle and easily damaged which, unlike many other food substances, not only results in a non-aesthetic appearance, but also in a non-useful food product. Obviously, if the shells are broken, they cannot appropriately hold the other food substances that are commonly placed within the shells. A consumer would thereby have little use for them. Compounding this problem is that fact that consumers desire to be able to see the shells without opening the packaging so that they can determine, before purchasing, whether the shells have already been broken due to handling and shipping.

One prior method of packaging taco shells includes contiguously aligning, or stacking, the shells with respect to each other and merely placing them in a cardboard container with a cellophane wrapping sealed about the container. A major disadvantage with that packaging is that the shells freely contact the cardboard interior walls upon shipping and handling. They are also free to separate from one another, causing a loss of the support they would otherwise provide to each other. The result is significant breakage.

Another packaging method provides contiguously aligned shells have a wedge shaped cardboard element disposed between the interior surfaces of one shell. The shells and such cardboard element are then sealed by a cellophane element and then placed within a cardboard box. While the wedge element minimizes the damage that might otherwise occur to the shell disposed about the wedge shaped element, and perhaps some of the immediately adjacent shells, all the shells remain free to impact the interior surfaces of the cardboard box during handling and shipping.

A need still exists in the art to provide an improved container for packaging brittle food substances and particularly taco shells.

SUMMARY OF THE INVENTION

One object of the present invention is to provide an improved container for packaging fragile or brittle food substances.

Another object of the present invention is to provide a container that is particularly useful in packaging contiguously aligned taco shells.

An additional object of the present invention is to provide a container that enables consumers to view a plurality of taco shells therein without opening the container.

An even further object of the present invention is to provide a container that holds a plurality of taco shells in an alignment with respect to one another and restricts their movement within the container.

Furthermore, an object of the present invention is to assist in forming the taco shells during their processing.

These and other objects of the present invention are accomplished by providing in a container having a plurality of wall members at least a first member fixed interiorly of the container for maintaining the food substance in a position that enables the food substance to remain free of contact with a first wall member, the first member having an irregular surface configuration for frictionally engaging opposing surfaces of the food substance and limiting movement of the food substance along a first axis. In combination with the first member the invention includes a second member fixed interiorly of the container for maintaining the food substance in a position that enables the food substance to remain free of contact with a second wall member, the second member having a surface that can intermittently contact a surface of the food substance.

These and other objects of the present invention can be seen by an examination of the specification, claims, and the drawings hereto.

DESCRIPTION OF THE PREFERRED EMBODIMENT

The following description is provided to enable any person skilled in the packaging field to make and use the present invention, and sets forth the best mode contemplated by the inventor of carrying out his invention. Various modifications, however, will remain readily apparent to those skilled in this art, since the generic principles of the present invention have been defined herein specifically to provide an improved packaging container for brittle yet perishable food substances, such as taco shells.

The following description is presented in the context of packaging taco shells. However, artisans will understand that the present invention has application to other food and non-food substances, particularly those that are fragile or brittle and have a configuration similar to that of a taco shell.

Figure 1:
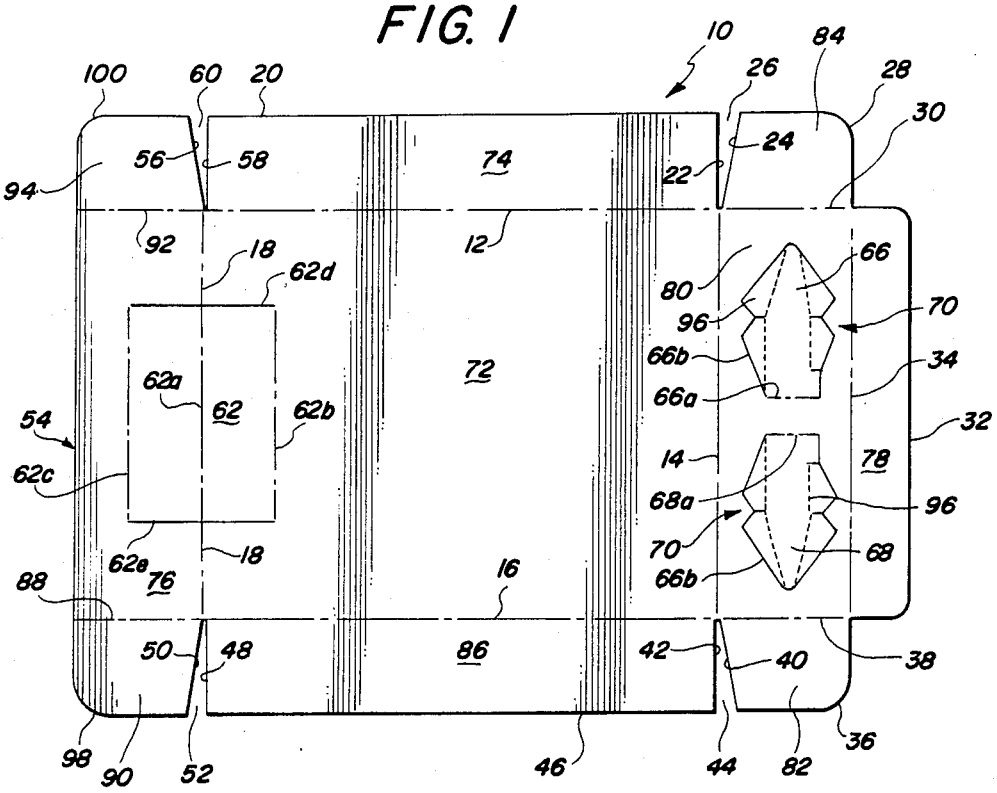
FIG. 1 is a view of a blank than can be folded into the shape of a container.

A blank 10 is depicted in FIG. 1 and is preferably a generally rectangular shaped element made of a relatively thin, flat paper board. The blank 10 is generally defined by a pair of parallel extending longitudinal edges 20, 46 that define in most part the longer sides of the blank 10. One of the shorter sides of the blank 10 is defined by a transverse edge 54 having two rounded edges 100, 98, both of which are configured in a generally rounded right angle so that the distal portions of the two edges 100, 98, respectively align with the longitudinal edges 20, 46. The other shorter side of the blank 10 opposite the transverse edge 54 is described by a transverse edge 32 positioned intermediate a pair of rounded edges 28, 36, the two rounded edges being configured like the rounded edges 98, 100. The transverse edge 32 extends generally parallel to the transverse edge 54. One end of the transverse edge 32 is configured in a rounded right angle so that the distal end thereof is positioned parallel to the transverse edge 20 and intersects one end of the rounded edge 28 at a right angle thereto. The other end of the transverse edge 32 is similarly configured at a right angle and has a distal end that extends parallel to the transverse edge 46 and intersects one end of the rounded edge 36 at a right angle thereto.

The outside edge of the blank 10 is further described by the pair of rounded edges 28, 36 which are positioned respectively at the ends of the transverse edges 20, 46 that are opposite the rounded edges 100, 98. One end portion of the rounded edge 28 thereby lies parallel to the transverse edge 20 while the other end portion of the rounded edge 28 lies perpendicular to the transverse edge 20. The rounded edge 36 has one end portion that lies parallel to the longitudinal edge 46. The other end portion of the rounded edge 36 lies perpendicular to the longitudinal edge 46.

Four slots 26, 44, 52, 60 further define the outside edge of the blank 10. The slot 26 is described by a pair of corner edges 22, 24 disposed in a generally "V"-shaped configuration, the former of which extends from an end of the longitudinal edge 20 nearest the transverse edge 32 and to the intersection of a longitudinal fold line 12 and a transverse fold line 14 in the blank 10, the fold lines 12, 14 lying parallel respectively to the longitudinal edge 20 and the transverse edge 32. The corner edge 24 extends from the distal end of the rounded edge 28 that lies parallel to the longitudinal edge 20 and to the intersection of the fold lines 12, 14. The remaining slots 40, 52, 60 are similarly configured and defined by respective corner edges.

The slot 44 is described by a pair of corner edges 40, 42, the former extending from the distal end of the rounded edge 36 that is parallel to the longitudinal edge 46 and to the intersection of the fold line 14 and a longitudinal fold line 16 in the blank 10 which lies parallel to the longitudinal edge 46. The corner edge 42 extends from the end of the longitudinal edge 46 nearest the transverse edge 32 and to the intersection of the fold lines 14, 16.

The slot 52 is positioned at the end of the longitudinal edge 46 opposite the slot 44 and is described by a pair of corner edges 48, 50. The corner edge 48 extends from the end of the longitudinal edge 46 and towards the intersection of the fold line 16 with a transverse fold line 18 in the blank 10 that lies parallel to the transverse edge 54. The corner edge 50 extends from the distal end of the rounded edge 98 that is parallel to the longitudinal edge 46 and to the intersection of the fold lines 16, 18.

The slot 60 is positioned at the end of the longitudinal edge 20 opposite the slot 26. The slot 60 is described by a pair of corner edges 56, 58, the latter of which extends from the end of the longitudinal edge 20 and towards the intersection of the fold lines 12, 18. The corner edge 56 extends from the distal end of the rounded edge 100 that is parallel to the longitudinal edge 20 and to the intersection of the fold lines 12, 18.

A rectangular shaped base panel 72 is provided in the blank 10 and described by the fold lines 12, 14, 16, 18. A pair of side panels 74, 86 are also provided, the former being described between the fold line 12, the longitudinal edge 20, and the corner edges 22, 58. The side panel 86 is at the opposite side of the base panel 72 and is described by the fold line 16, the longitudinal edge 46, and the corner edges 42, 48.

A top panel 80 is provided at one of the shorter sides of the base panel 72 and a bottom panel 76 is provided at the other shorter side. The bottom panel 76 is rectangular in shape and described by the fold line 18, the transverse edge 54, and a pair of fold lines 88, 92. The fold lines 88, 92 lie parallel respectively to the longitudinal fold lines 16, 12. The top panel 80 is also rectangular in shape and described by the fold line 14, a fold line 34 extending parallel to the fold line 14, and a pair of fold lines 30, 38 which lie parallel respectively to the fold lines 12, 16. A lid panel 78 extends from the top panel 80 and is defined by the transverse edge 32 and the fold line 34.

Four corner panels are provided in the blank 10, one at each of the four opposing corners thereof. A corner panel 84 is positioned at the intersection of the fold lines 12, 14 and is described by the curved edge 28, the corner edge 24, and the fold line 30. A corner panel 94 is positioned at the intersection of the fold lines 12, 18 and is described by the rounded edge 100, the fold line 92, and the corner edge 56. A corner panel 90 is positioned at the intersection of the fold line 16, 18 and is described by the rounded edge 98, the fold line 88, and the corner edge 50. A corner panel 82 is provided at the intersection of the fold lines 14, 16 and described by the rounded edge 36, the fold line 38, and the corner edge 40.

Figure 2:
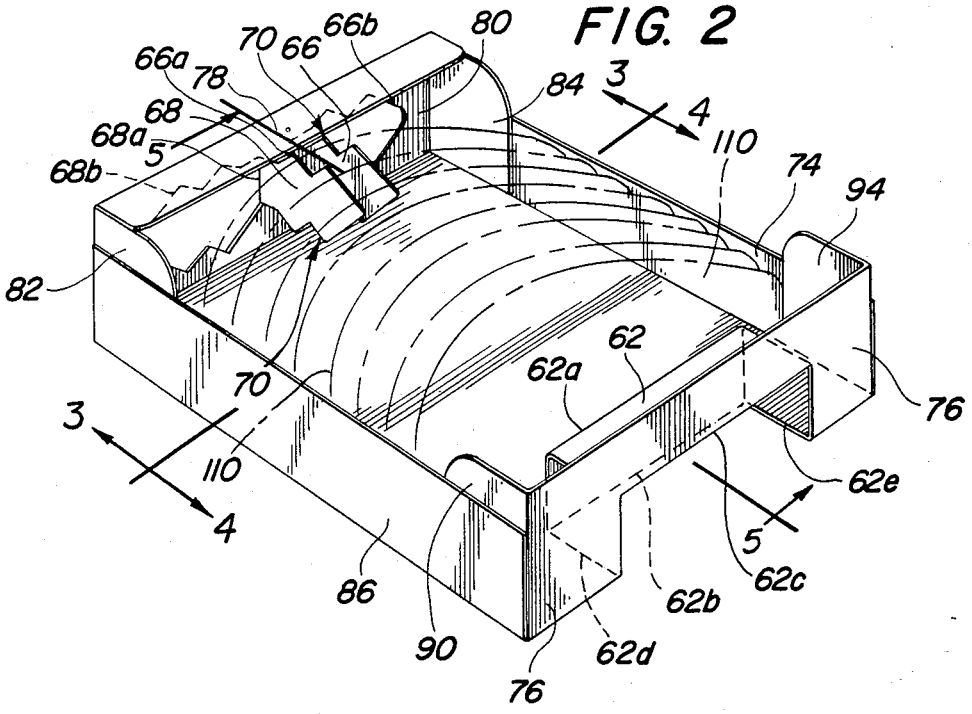
FIG. 2 is a perspective view of the blank in a folded state.

As shown in FIG. 2, a holding member 66 and a holding member 68 are swingably fixed to the top panel 80, the former being attached along a fold line **66*a* and the latter being attached along a fold line 68*a*. The fold lines 66*a*, 68*a* are positioned parallel to each other and parallel to the fold lines 30, 38. The fold lines 66*a*, 68*a* are each of a length less than that of each length of the fold lines 30, 38**.

Figure 5:
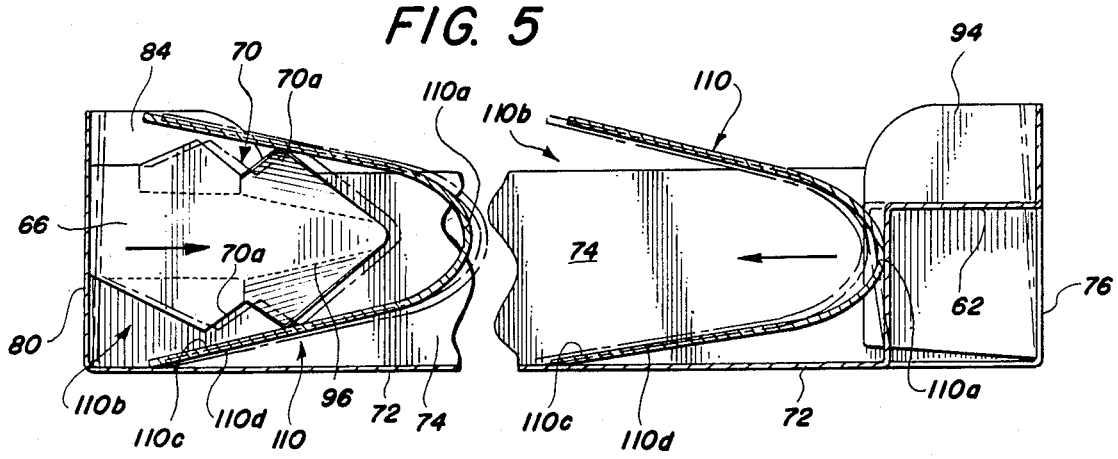
FIG. 5 is a partial, exploded view of FIG. 1 taken along line 5—5.
Figure 3:
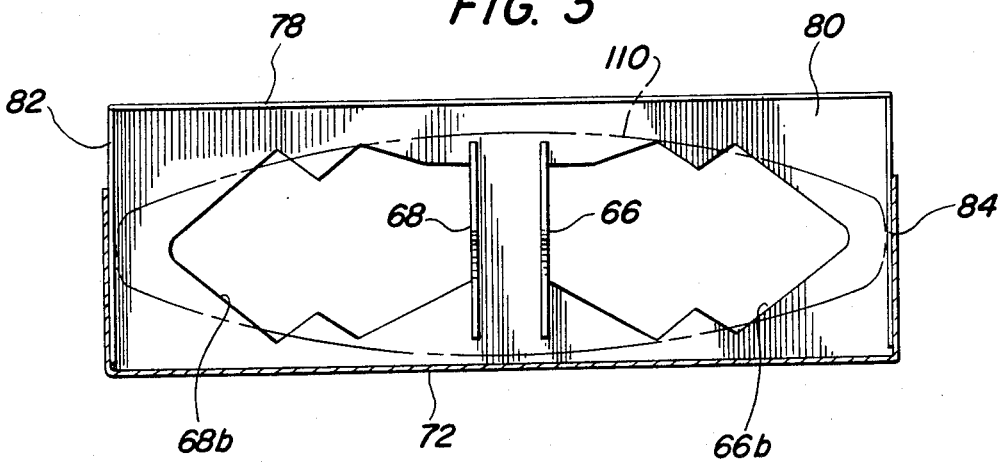
FIG. 3 is an exploded view of FIG. 1 taken along line 3—3.

The holding members 66, 68 are similarly configured and dimensioned and described by respective cut lines **66*b*, 68*b*. Each holding member is thereby configured in a generally wedge shape whose pointed ends are positioned opposite their respective fold lines 66*a*, 68*a*. The middle edge portion of each holding member has opposing serrated edges 70 in a "W" configuration whereby the two points at the bottom of such configuration extend away from the center portions of the holding members. Each holding member further has a slot at the intersection of the two "V" portions that make up the "W" configuration. The distance between the opposing serrated edges 70 of each holding member 66, 68 is of a length approximately equal to the distance between the opposing interior surfaces of a taco shell 110 at generally its middle portion, as best shown in FIGS. 3 and 5. Each serrated edge 70 has a pair of triangular shaped contact points 70*a*. Two sets of perforations 96 are also on each folding member 66, 68 and extend from the pointed end portions of the wedge configurations, along the opposing serrated edges 70, and towards the respective fold lines 66***a*, 68*a*.

Figure 4:
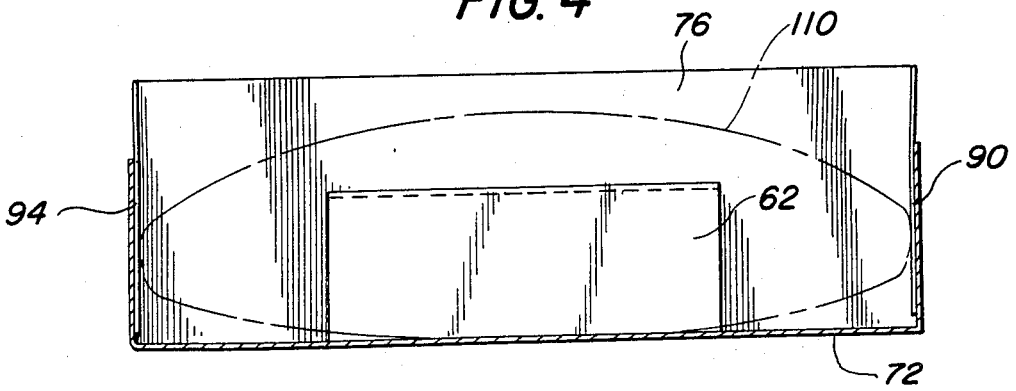
FIG. 4 is an exploded view of FIG. 1 taken along line 4—4.

A bottom support member 62 is provided and positioned between the base panel 72 and the bottom panel 76. The support member 62 is described by a fold line 62*a* which extends parallel to the transverse edge 54 and is of a length approximately equal to one half of the length of the transverse edge 54. A fold line 62b is positioned in the base panel 72 and extends parallel to the fold line 62*a* and is of a length similar to that of the fold line 62*a*. A fold line 62*c* extends parallel to the fold lines 62*a*, 62*b* and is positioned generally in the middle of the support member 62 and lies parallel to the fold line 62*b*. A pair of cut lines 62*d*, 62*e* further describe the support member 62 and are each positioned parallel to one another and perpendicular to the fold lines 62*a*, 62*b*. As seen in FIGS. 4 and 5, each cut line 62*d*, 62*e* is of a length that is approximately three-fourths maximum distance between the interior surfaces of the shell 110.

Referring to FIG. 2, the blank 10 is shown in its folded state. The side panels 86, 74 are respectively folded along the fold lines 16, 12 in a manner such that each side panel has its planar surface positioned above and perpendicular to the planar surface of the base panel 72. The bottom panel 76 is folded along the fold line 18 so that the planar surface of the bottom panel 76 is positioned above the planar surface of the base panel 72 and perpendicular to it. The corner panels 90, 94 can then be folded along their respective fold lines 88, 92 so that the planar surfaces of each corner panel lie perpendicular to the bottom panel 76 and parallel to each other. Thereby, the corner panel 90 interfaces the side panel 86 and remains interiorly of the blank 10, and the corner panel 94 interfaces the side panel 74 and remains interiorly of the blank 10.

As the bottom panel 76 is folded along the fold line 18, the bottom support member 62 becomes folded along the fold line 62*a*, 62*b*, 62*c*. The support member 62 thereby takes on a configuration having two planar surfaces at generally right angles to each other. The portion of the bottom member 62 between the fold line 62*b* and the fold line 62*a* is positioned generally perpendicular to the base panel 72. The portion of the bottom member 62 between the fold line 62*a* and the fold line 62*c* is positioned above the base panel 72 and lies generally parallel to it.

The top panel 80 is folded along the fold line 14 so that its planar surface is disposed above the base panel 72 and perpendicular to it. The corner panel 82 is folded along the fold line 38 so that its planar surface is positioned perpendicular to the planar surface of the top panel 80 and is disposed interiorly of the blank 10 while interfacing the side panel 86. In a similar fashion, the corner panel 84 is folded along the fold line 30 so that its planar surface remains perpendicular to the planar surface of the top panel 80 and is disposed interiorly of the blank 10 while interfacing the side panel 74. The lid panel 78 is folded along the fold line 34 so that its planar surface remains perpendicular to the planar surface of the top panel 80.

The container formed by the blank 10 is particularly suitable for the packaging and sorting of a plurality of taco shells 110 or other brittle substances, whether for human consumption or not. The taco shells 110 are conventionally made with corn and processed into a generally flat, circular configuration and partially folded along a diameter therein to form a "U"-shaped shell 110. In FIG. 5, the shell 110 has a bottom portion 110*a* that generally includes that portion of the shell 110 folded along the diameter and has an open or top portion 110*b* that is opposite the bottom portion 110*a*. The shell 110 consequently includes an exteriorly convexed surface 110*d* and interior surface 110*c*.

The shells 110 are contiguously aligned with respect to one another in FIG. 2. One shell 110 has its bottom portion 110*a* of the exterior surface 110*d* interfacing the portion of the bottom support member 62 between the fold line 62*a* and the fold line 62*b* (FIG. 5). A second shell 110 is similarly positioned with respect to the bottom support member 62 and has its exterior surface 100*d* interfacing the interior surface 110*c* of the first shell 110. That relationship between immediately adjacent shells 110 continues along the base panel 72 until a last shell 110 interfaces the holding members 66, 68.

Figure 6:
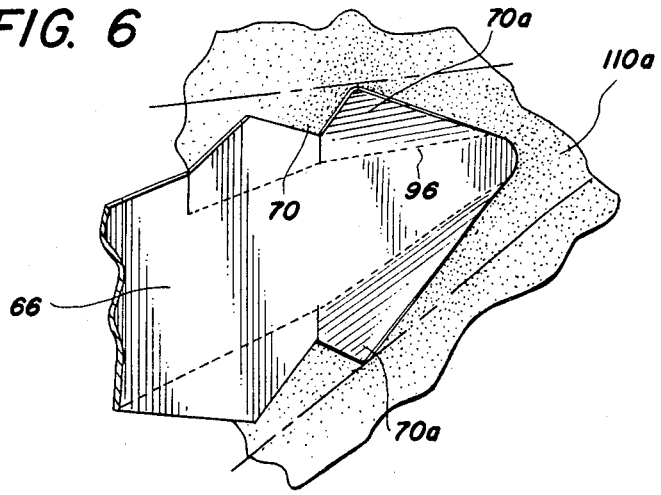
FIG. 6 is a partial view of a holding member that is engaged to a taco shell.

The last shell 110 has its interior surface 110*c* frictionally engaged to the two holding members 66, 68, as best shown in FIGS. 5 and 6. The manner in which each holding member 66, 68 engage the shell 110 is described herein with respect to only the holding member 66. However, such description is equally applicable to the holding member 68.

As indicated above, the holding member 66 has opposing serrated edges 70. Each pair of contact points 70*a* of the serrated edges 70 frictionally engage the interior surface 110*c* of the shell 110. Preferably, however, only the contact point 70*a* on each serrated edge 70 nearest the bottom portion 110*a* of the shell 110 engages the interior surface 110*c*. As better shown in FIG. 6, the interior surface 110*c* is rough in texture to enable the contact points 70*a* to frictionally contact the surface 100*c* without materially damaging it. This is the result of the contact points 70*a* providing a resiliency character to the holding member 66, since the points 70*a* are capable of limited deflection along the perforations 96 and at the apex of each contact point 70*a*.

To further maintain the shells 110 in a position within the blank 10, a cellulose member or other appropriate conventionally designed element can be wrapped about the exterior of the blank 10 to provide a sealed package. The cellulose element also maintains the blank 10 in its folded form, and without which the blank 10 would otherwise be partially or totally unfolded.

As can be appreciated, the present invention minimizes breakage of the shells 110 from forces external to the container along a longitudinal axis that extends between the top panel 80 and the bottom panel 76 and parallel to the longitudinal edges 20, 46. The shells 110 are also protected from breakage from forces along a transverse axis that extends between the two side panels 74, 86 and lies parallel to the transverse edges 32, 54. In addition, the shells 110 are protected from external forces along a vertical axis that is perpendicular to the planar surface of the base panel 72. Furthermore, the present inention assists in forming the shells 110 during their processing.

As forces are applied to the container along the longitudinal axis in a direction from the top panel 80 and towards the bottom panel 76, the top panel 80 is deflected towards the bottom panel 76, which causes the holding members 66, 68 are displaced towards the bottom panel 76, as depicted in FIG. 5. Such displacement causes the serrated edges 70 on the members 66, 68 to become further deflected along their respective perforations 96 and at the apexes of their contact points 70*a*. Consequently, the shell 110 disposed immediately about the holding members 66, 68 is displaced towards the bottom panel 76. The displacement, in turn, causes the immediately adjacent shell 110 to be displaced towards the bottom panel 76. This transfer of displacement occurrs through adjoining shells 110. Depending upon the amount of external force being applied, the number of shells 110 to which the displacement is transfered will vary. The bottom support member 62 limits the amount of displacement of the shells 110 towards the bottom panel 76. In any event, the resiliency character of the holding members 66, 68 prevent material damage to the shells 110 upon displacement thereof.

In a similar fashion, when an external force is applied along the longitudinal axis from the bottom panel 76 and towards the top panel 80, the bottom support member 62 is deflected towards the top panel 80 and contacts the exterior surface 110*d* of the shell 110 immediately adjacent it, if the member 62 is not already in contact with it. The member 62 displaces the shell 110 towards the top panel 80, which displacement is then transferred to the adjoining shells 110 as above. The holder members 66, 68 limit the amount of displacement of the shell 110 towards the top panel 76. When the external force is removed, the bottom support member 62 will have a tendency of moving away from the shells 110 and be free from contact with them.

Damage to the shells 110 is minimized by the side panels 74, 86 from external forces along the transverse axis. The side panels are of a height approximately equal to the maximum distance between the opposing interior surfaces 110*c* of the shells 100. This provides a force resistive element along the edges of the shells 110 that would otherwise be exposed.

External forces along the vertical axis moving from below the base panel 72 to above it are minimized by the bottom panel 72 itself providing an absorbing effect to such force. Forces along the vertical axis from the top side of the base panel and towards the bottom side of the bottom panel 72 are minimized by the cover panel 78 which is disposed over at least a portion of the shell 110 immediately interfacing the holding members 66, 68. In addition, the corner panels 82, 84, 90, 94 are each of a height to provide points at which such forces can be absorbed without contact to the shells 110.

The holding members 66, 68 serve a function in addition to that described above. The processing of taco shells commonly involves frying the shells. When the shells are fried, they remain pliable for a period of time before they harden upon drying. Because of their pliableness, their top portions 110*b* can close or become shaped in some other undesirable configuration. The holding members 66, 68 can be engaged to the shells 110 during the time they are pliable. The resilient character of the members 66, 68 allows the members to flex while being inserted into the first shell 110 of a set of shells to be packaged. This causes the top portion 110*b* of the first shell 110, and thus the remaining shells 110, to take on appropriate configurations. The shells 110 can thereby be left to harden with the appropriate configurations.

It is understood, of course, that the foregoing description relates only to a preferred embodiment of the present invention and that modifications thereto may nevertheless come within the scope of the invention, wherein I claim:

1. An improved packaging blank for taco shells, each shell being brittle and similarly configured and dimensioned, the shells being contiguously aligned to each other by having the interior surface of each shell disposed about the exterior surface of the adjacent shell, the improvement comprising:

a base panel for supporting the shells along a plane;

a top panel extending from the base panel and having a planar surface that can be positioned perpendicular to a first axis;

a bottom panel extending from the base panel and having a planar surface that can be positioned perpendicular to the first axis;

a pair of side panels extending from the base panel, each side panel having a planar surface that can be positioned perpendicular to a second axis that is perpendicular to the first axis, the planar surfaces capable of remaining in contact with the edges of the shells;

first means fixed to the planar surface of the top panel for maintaining the shells in a position along the base panel by operatively engaging the opposing interior surfaces of a first shell that interfaces the top panel, the first means including at least a first holding member having perforations and resilient, serrated opposing edge surfaces that are configured and dimensioned to extend along the interior surfaces of the first shell without contacting the bottom portion thereof particularly upon forces external to the blank being applied along the first axis; and second means fixed to the planar surface of the bottom panel for maintaining the shells in a position along the base panel, the second means having a flat surface area that operatively interfaces an exterior surface of a second shell to contact such exterior surface upon forces external to the blank being applied along the first axis.

2. The invention of claim 1 wherein the first means includes a second holding member that can interface the first holding member and is configured and dimensioned like the first holding member.

3. The invention of claim 1 wherein second means comprises two planar surfaces positioned perpendicular to each other.

4. The invention of claim 1 wherein the top and bottom panels are each dimensioned with a surface length that is longer than the maximum length measured between the opposing interior surfaces of a shell.

5. The invention of claim 1 wherein the base panel has a generally rectangular configuration with a planar surface whose length is longer than that length defined by the aggregate of the shells being continguously aligned, the latter length being measured between the top and bottom portions of each shell.

6. The invention of claim 1 further comprising a lid member extending from the top panel that can be positioned adjacent to at least the top portion of the first shell.

* * * * *